United States Patent [19]

Beall et al.

[11] Patent Number: 4,974,857

[45] Date of Patent: Dec. 4, 1990

[54] ELECTRONIC DART GAME

[75] Inventors: Paul F. Beall; Eugene G. Harlan, both of Rockford, Ill.

[73] Assignee: Arachnid, Inc., Rockford, Ill.

[21] Appl. No.: 260,992

[22] Filed: Oct. 20, 1988

[51] Int. Cl.[5] ..... F41J 5/04; F41J 5/24

[52] U.S. Cl. ..... 273/371; 273/376; 273/381; 273/DIG. 27

[58] Field of Search ..... 273/176 F, 176 FB, 381, 273/376, 1 E, 1 ES, 371, 373, 374, 377, 378, DIG. 27; 434/116; 340/323 R

[56] References Cited

U.S. PATENT DOCUMENTS

| | | | |
|---|---|---|---|
| 854,640 | 5/1907 | Fuller | 273/381 |
| 1,075,264 | 10/1913 | Morrison, Jr. . | |
| 1,338,963 | 4/1918 | Rolfe | 273/176 F |
| 2,818,259 | 12/1957 | Arenson . | |
| 3,039,771 | 6/1962 | Bablouzian | 273/DIG. 27 |
| 3,309,091 | 3/1967 | Haecker . | |
| 3,455,553 | 7/1969 | Melvin . | |
| 3,727,918 | 4/1973 | Zawacki | 273/176 FB |
| 3,790,173 | 2/1974 | Callaway . | |
| 3,791,653 | 2/1974 | Yamada | 273/381 |
| 4,057,251 | 11/1977 | Jones et al. | 273/95 R |
| 4,270,751 | 6/1981 | Lowy | 273/381 |
| 4,561,660 | 12/1985 | Zammuto | 273/376 |
| 4,567,461 | 1/1986 | Honekman et al. | 340/323 R |
| 4,586,716 | 5/1986 | Brejcha et al. | 273/376 |
| 4,635,940 | 1/1987 | Kelley | 273/347 |
| 4,651,998 | 3/1987 | Holt et al. | 273/347 |
| 4,706,962 | 11/1987 | Michalski | 273/347 |
| 4,793,618 | 12/1988 | Tillery et al. | 273/376 |

FOREIGN PATENT DOCUMENTS

| | | | |
|---|---|---|---|
| 0182397 | 5/1986 | European Pat. Off. | 273/371 |
| 2130107 | 5/1984 | United Kingdom | 273/376 |

OTHER PUBLICATIONS

Project "Arachnid" Report on the Pre-University Course Project, 1973.

"Audio Device for the Blind—IBM Technical Disclosure Bulletin," vol. 21, No. 9, Feb. 1979, by S. M. Head, et al.

*Primary Examiner*—Edward M. Coven

*Assistant Examiner*—Jessica J. Harrison

*Attorney, Agent, or Firm*—Leydig, Voit & Mayer

[57] ABSTRACT

An electronic dart game capable of being played by sight-impaired persons. The game includes a dart face forming a target for darts thrown by the players, the dart face including a plurality of scoring segments. An electronic processor is associated with the dart face for detecting a hit segment and determining the value of the segment which has been hit. An audible announcing device is associated with the processor and is responsive to the processor for audibly announcing sufficient information to direct and score the game without the need for viewing of visible indicators. As a further feature of the invention, as rollout mat is provided having an integral throwing line and affixed to the cabinet. In one condition, the rollout mat is completely stored within the cabinet and in the other can be simply rolled out to automatically position the throwing line, the throwing line being physically perceptible by a sight-impaired person to locate him with respect to the target face.

11 Claims, 5 Drawing Sheets

ELECTRONIC DART GAME

FIELD OF THE INVENTION

This invention relates to electronic games, and more particularly to electronic dart games in which the game and score advances intermittently from throw to throw and player to player, dependent upon the score registered by a dart thrown by a player.

BACKGROUND OF THE INVENTION

Electronic dart games are well known from Jones et al. U.S. Pat. Nos. 4,057,251 and Zammuto 4,561,660. These patents relate to the use of "safe" darts made with a slender flexible plastic tip which is virtually incapable of piercing human skin and unlikely to cause damage when hitting objects other than the dart board. Jones et al. introduced the "safe" darts and a dart board divided into an array of target plates with a large number of closely spaced holes for securing darts thrown at the board. The impact force of a thrown dart displaces a target plate and momentarily closes an associated switch to electrically indicate a dart hit. Zammuto improves on the game by using a solid rubber damper sheet for biasing target segments and a matrix switch of imprinted Mylar sheets to increase reliability in scoring.

Electronic dart games of the foregoing type usually have sophisticated displays for displaying the score of each player, a temporary score for the player who is then shooting, and other indicators directing the advance of the game from throw to throw and player to player. Certainly darts can also be played without such sophisticated displays, such as the conventional steel tipped dart game which is the typical British pub game. However, there the players have to be very concerned about what score is hit with each dart, and must themselves determine the score of each player, typically kept track of on a chalk board on the wall, and remember the advance of the game from throw to throw and player to player.

It is believed that the popularity of electronic dart games resides not only in the increased safety which inures to the flexible tipped dart, but also to the sophistication of the game electronics in keeping track of the score and the advance of the game quite without excess attention from the players. As a result, players without significant skill in darts can and do employ electronic dart games as not only a sport but also light amusement.

People with sight impairment, such as blind people, have been known to adapt physically to target games such as darts by use of a rather keen sense of direction coupled with a known physical position with respect to the dart target. However, because of the complexities which can be involved in dart games relating to the score of any individual player and the advance of the game, it has not been possible for blind players, even when they have trained themselves to accurately throw darts at the target face, to play the game independently because of lack of ability to perceive the rather sophisticated visual scoring devices on the machine.

Electronic games are also known which include voice synthesizers which allow the machine to "speak" verbal messages to a player and/or his audience. It is believed that the most sophisticated "speaking" electronic games have developed in the electronic pinball game area, which are relatively continuous games where the score continues to advance depending on targets hit by a continuously rolling ball. Thus, while pinball games have been adapted to announce certain game key events, it would be difficult if not impossible to continuously appraise the state of the game by audible announcements.

SUMMARY OF THE INVENTION

In view of the foregoing, it is a general aim of the present invention to provide an electronic dart game which can be played by blind persons, sight-impaired persons or others who choose to play the game using stimuli, at least in part, which are other than visual.

In that regard, it is an object of the present invention to provide an electronic dart game adapted to audibly guide the user through a complex game including the status of the game and the score of each player.

It is a distinct object of the invention to provide an electronic dart game which can be quickly set up or moved, requiring only moments after positioning to render the game ready for play.

BRIEF DESCRIPTION OF THE DRAWINGS

Other objects and advantages of the invention will become apparent from the following detailed description and the accompanying drawings, in which.

While the invention will be described in connection with a preferred embodiment, there is no intent to limit it to that embodiment. On the contrary, the intent is to cover all alternatives, modifications and equivalents included within the spirit and scope of the invention as defined by the appended claims.

DETAILED DESCRIPTION OF THE PREFERRED EMBODIMENTS

Figure 1A:
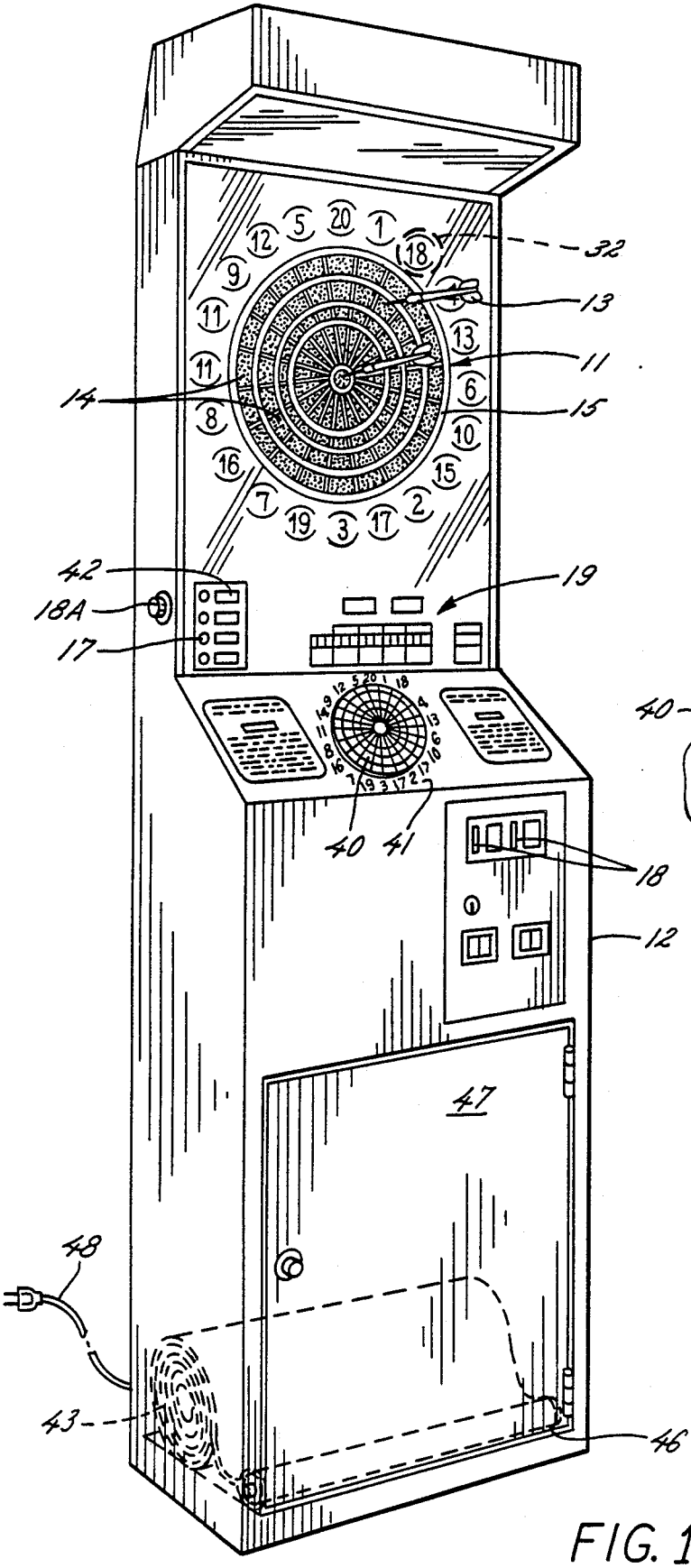
FIG. 1A is a perspective view of an electronic dart game exemplifying the present invention.
Figure 1B:
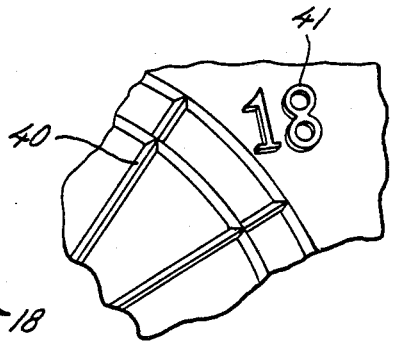
FIG. 1B is a partial view showing a portion of the raised instruction panel.
Figure 2:
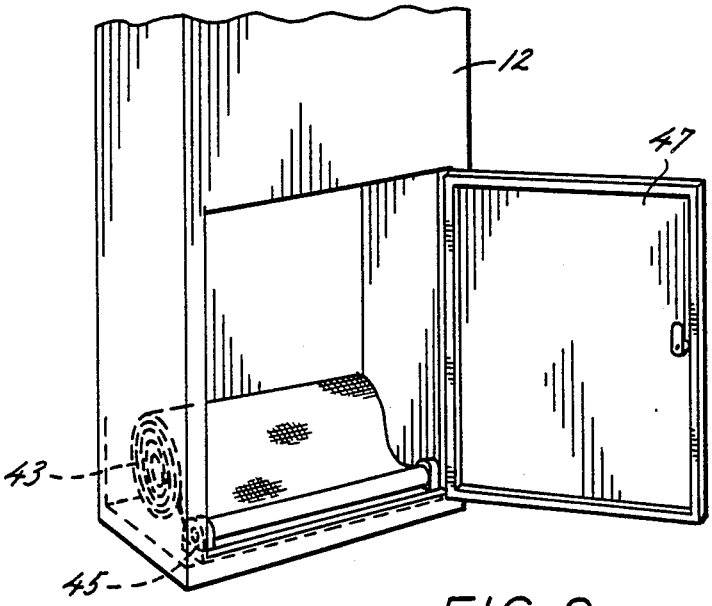
FIGS. 2 and 3 are partial perspective views showing the rollup mat with integral throwing line stored and deployed respectively.

Turning now to the drawings, FIG. 1 shows an embodiment of the invention having an electronic dart board 11 mounted in an upright cabinet 12. It is seen that the cabinet 12 is floor standing and disposes the target face or dart board 11 at a predetermined height above the floor, typically at about eye level of a person of average height. The electronic dart board 11 serves as a target for darts 13 which are adapted to be thrown at the board. The darts are preferably of the "safe" type in that they are virtually incapable of penetrating skin and unlikely to cause damage by accidentally hitting objects other than the dart board. The dart board 11 is divided into a plurality of separate target segments or plates 14 denoting different target areas. Each target plate contains a large number of closely spaced holes for securing a dart in the segment by its tip after being thrown at and striking the target segment.

In the illustrated embodiment, the target plates 14 are slidably mounted in a spider framework 15 of radially extending ribs and concentric circular ribs thereby preventing lateral movement of the target segment. Each rib is of substantially triangular cross-section so that if struck by a dart, the dart deflects off to one of the target segments and into a hole instead of merely bouncing off the rib. To insure proper sliding movement in the spider framework 15, target segments 14 typically have guides attached to their outside edges in the form of ridges. Each of the target segments has a switch device located behind such that the impact force of a thrown dart hitting a target segment displaces the target segment back to a position which closes the switch momentarily signaling a target segment hit; the target segment then returns to its normal open position at the face of the board. The switches associated with the target segments are kept in their normally open positions by biasing the target segments to the face of the board using a resilient biasing material such as a solid rubber sheet. A switch matrix of imprinted Mylar sheets are preferably used, providing switching of the desired duration and continuity during the momentum transfer from a dart.

On the control panel 16 of the dart game are several push button switches 17 for selecting between different dart games and various game options such as the number of players. A next player button is provided to signal, when necessary, to the game that a particular player's turn is over. In the event that a player throws a dart and misses the dart board completely, the game will be unable to detect this miss until the player presses the next player button indicating that he has thrown 3 darts and his turn is over. A pair of coin slots 18 are located in the base of the machine for operating this coin-operated version of the game. Alternatively, and particularly useful for blind tournament play, a pushbutton switch **18*a* is disposed in a convenient location, such as on the side of the cabinet, and is connected in parallel with the coin slot switch for allowing the selection of a particular number of players for a game without depositing of coins. In particular configurations, either or both of the coin slots 18 and manual pushbutton 18*a*** may be provided.

As in a conventional electronic dart game, display means 19 is located alongside the control panel 16 for displaying various information about the operation and conditions of the game. In the initial stage of a game the display 19 indicates the number of coins dropped into the machine and the corresponding game options available, or the number of players selected by way of the pushbutton **18*a*. The number of players in the game is determined by the number of coins received through the coin slots 18, or the number of depressions of the pushbutton 18*a*. The display 19 in conventional fashion guides a player with sight through the selection of a game and the number of players in the game. As a function of its display capabilities, the display means 19** can also allow for more than one display device such as a video display screen, liquid crystal display, electronic display or the like.

In accordance with the invention, in addition to the displays for guiding a player with sight through the game selection process, the electronic dart game of FIG. 1 also includes audible announcing means for providing guidance to a sight-impaired person. More particularly, the game of FIG. 1 includes a speaker 32 positioned in a known and fixed location in the cabinet 12 which cooperates with electronic control means for audibly announcing sufficient information to direct and score the game without the need for viewing of the aforementioned visual indicators. In the embodiment illustrated in FIG. 1, the speaker 32 is located inside the cabinet 12 just behind the number 18 at the upper portion of the dart board 15, and is indicated by the dashed circle 32.

The audible announcing means for the game of FIG. 1 can have several modes, including an attract mode, a game setup mode and a game play mode. In the attract mode, various announcements can be made such as "Let's Play English Mark Darts".

In the setup mode, guidance is needed for the players in setting up a game prior to play. Messages which are typically used in the setup mode define the number of players and the next action to be taken, such as "1 (or 2 or 3 or 4) Players—Select Game". Thus, the sight-impaired person is informed of the number of players which the game is set up to service, and guides the player to the next step which is the selection of the game to be played. In response, the player depresses one of the game select pushbuttons 17 following which the game is adapted to announce the game which is selected such as "301", "501", "Count Up", or "Practice Game".

Having thus set up the game for play, the game then announces sufficient information to guide the player through the game, indicating the various stages during the advance of the game, and the score of each person as the game is advanced. It begins by announcing "Player No. 1 Throw Darts". As will be described in greater detail below, the dart board includes sensing means for detecting when one of the scoring segments is hit by a thrown dart. The processor which is coupled to the sensing means determines which scoring segment has been hit and determines the value of the hit scoring segment. Depending on the rules of the game, the processor then determines the advance of the game and the score for the player who had thrown the dart. Signals are then coupled from the processor to the audible announcing means for announcing to the players the advance of the game and the score of the active player. For example, the announcing means will announce whether a single, double or triple has been hit and the value of the scoring segment such as "Double 18". The announcing means, in a preferred embodiment, is then programmed to further announce the player and his current score such as "Player No. 1 Your Score Is 246".

Typically in most games the player is allowed three darts. Upon detection of the third dart, after announcing the value of the hit segment and the score of the player, (or upon detection of the depression of the player change switch which indicates the completion of one player's turn), the game will announce "Remove Darts". Following a time lag for allowing removal of the darts, the game will then announce "Player No. (next number) Throw Darts". The game then proceeds in that fashion with the announcing means audibly announcing sufficient information to inform the players which player is up, who should be throwing and when, and what the advance of the score for each player is until one of the players wins the game following which the game is programmed to announce "Player No.__ Wins".

Other announcements are also available such as indication of a stuck segment such as "Segment Double 17 Stuck" or an indication that the condition has been cured such as "Segment Is Released".

It will now be apparent that the audible announcing means which are provided in connection with such an intermittent action game such as the instant dart game provides a combination in which the intermittent nature of the game allows for a sufficient lull in the action to appraise the players of the state of the game, and the announcing means coupled to the game provides sufficient information to lead the players through the game even though they cannot see the visual indicators which are utilized in the normal course.

In addition to the announcing means, other physical means are provided for assisting sight-impaired persons in playing the games. First of all, the control panel includes a raised section including a raised target face with raised numbers 41 surrounding the target face indicating to the players what the target face looks like and where the numbers are with respect to each other on the target face. It also clearly indicates the double and triple ring as well as the bulls-eye. Raised indicators 42 adjacent the game select switches 17 can also be provided to assist the player in selecting the appropriate game.

The positioning of the speaker 32 is also of an assist to blind persons, particularly when the speaker is fairly directional. Once the player becomes accustomed the game and the position of the dart board with respect to the location from which the sound is emanating, he has a further aid in assessing the position of the target face.

Finally, means are provided for positioning the sight-impaired person with respect to the target face, shown herein as a rollout mat 43 having a physically perceptible throwing line 44 (see FIG. 3) integrally attached to the mat. The mat provides several features for a sight-impaired person, including a physically discernible pathway to approach the cabinet 12. The mat is of foam material and simply walking down the narrow foam aisle will lead the player directly to the cabinet. Secondly, a raised solid member, such as a wooden slat 44, is positioned transverse to the mat and forms a physically perceptible throwing line for the sight-impaired person. The base of the mat is affixed in a predetermined position by means of fasteners such as rod 45 in the cabinet, such that when the mat is rolled out from the cabinet the throwing line 44 is in a predetermined position with respect to the target face. A back marker 49 prevents the mat from rolling up while deployed and provides a standing area 43*a* for the active player. A slot 46 beneath the door 47 allows the door to be closed after the rollout mat is deployed. Thus, the sight-impaired person need only walk down the foam mat until he perceives the raised throwing line 44, following which he can turn around and position his body by means of physical contact between his foot and the throwing line to face the target head. When the game then announces "Throw Darts", the player is in position to respond and begin the game.

It is noted that the rollout mat with integral throwing line can be a useful feature for the conventional dart game installed in a moderately permanent location as well as for games used in tournament play which are moved into a site for the tournament then removed. The game is constructed such that the only connection needed is to supply electrical power to a power cord 48. The game can be positioned in any location and the rollout mat simply rolled from the cabinet to establish the throwing line in a predetermined position with respect to the target face no matter where the game is positioned. Thus, in setting up a tournament no attention need be given to locating machines precisely on a particular line or ruling throwing lines from the base of the positioned machines. Similarly, in establishments such as clubs where the game receives a fair amount of use, it is possible during after-hours cleanup to simply roll up the mat and store it (as illustrated in FIG. 1) allowing the floor to be mopped. When the game is again ready to be put into service, it is only necessary to open the cabinet, roll out the mat, close the door, and allow the players to begin.

Figure 4:
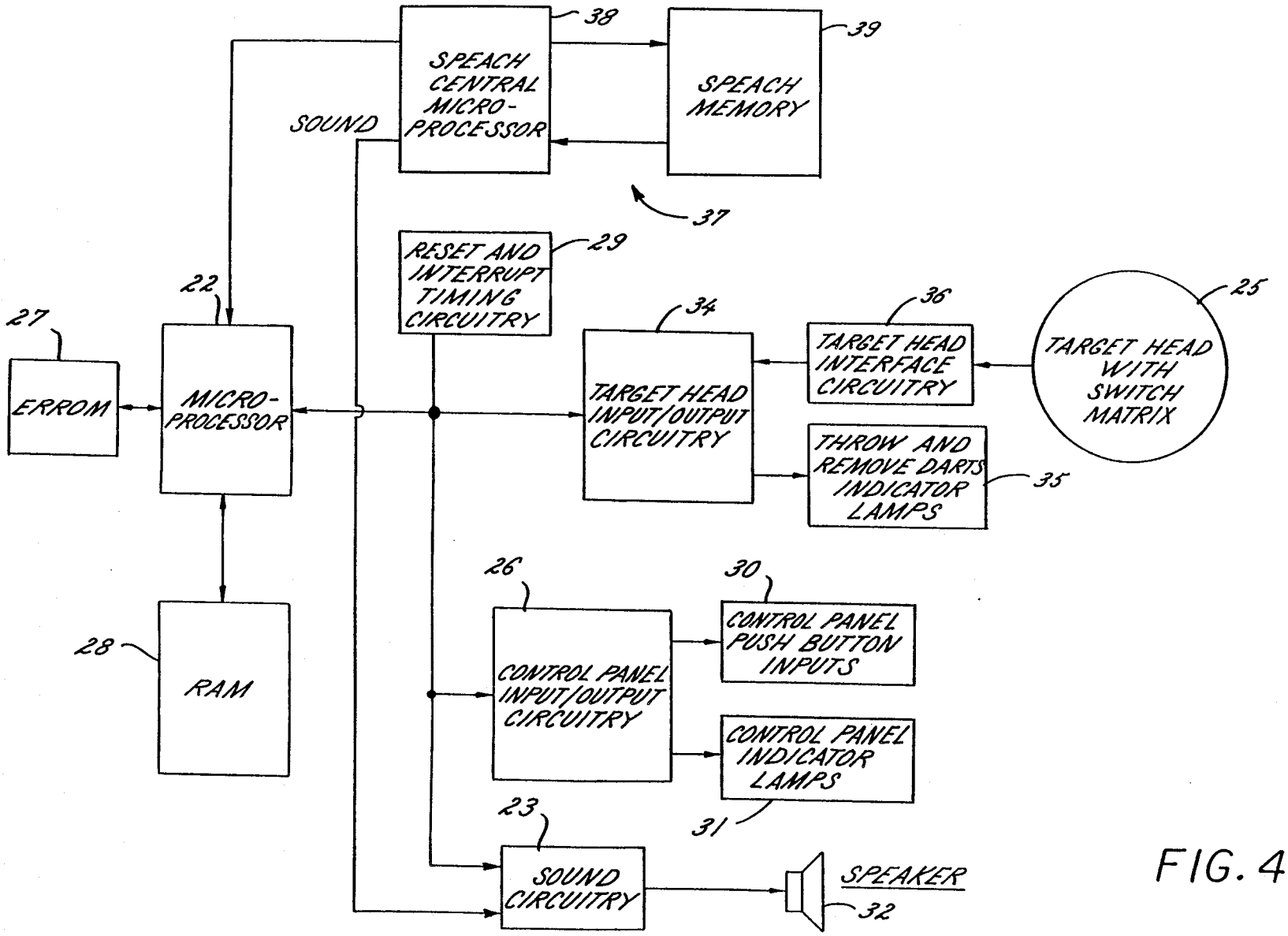
FIG. 4 is a block diagram illustrating the major electronic components of the dart game of FIG. 1.

Turning to FIG. 4, a block diagram of the internal components of a dart game according to the invention is shown. The microprocessor 22 is at the heart of the operation by providing signals for operating sound 23 and reading signals from the target head 34 and control panel input/output circuitry 26, and running instructions encoded in the erasable programmable read-only memory (EPROM) 27 for proper game operation. The microprocessor uses the random access memory (RAM) 28 as a working area to calculate and store temporary values. Preferably RAM 28 is supplied with an internal battery backup (not shown), and a small portion of the memory may be used by the microprocessor 22 to store high scores, game popularity data or similar values which are desired to be retained when the power is turned off. The EPROM 27 contains all the microprocessor instructions necessary for proper operation of the games. This includes instructions for initialization, game and player selection processes, and all the instructions necessary to play each of the available games. The EPROM 27 also includes instructions for output to speech synthesis circuitry 37 for causing appropriate announcements based on the state of the game as determined by the microprocessor 22.

Synchronization of the various operations of the system is done via the reset and interrupt timing circuitry 29 which alerts the system to interrupt and reset conditions, such as may occur when coins are dropped into the machine or certain control panel signals are received. The push button input 30 signals from the control panel are linked to the system via the control panel input/output circuitry 26. Indicator lamps 31 on the control panel are also driven by this control panel input/output circuitry 26. The microprocessor 22 sends appropriate signals to the speech synthesizer circuitry 37 which in turn is connected through sound circuitry 23 to speaker 32. The speech synthesizer circuitry 37 typically includes a commercially available speech synthesizer microprocessor 38 operating in conjunction with a speech memory 39. The speech memory stores data which is addressed by the microprocessor 38 in response to data received from microprocessor 22 which is interpreted by the microprocessor 38 to produce a sound. The words provided by the microprocessor 22 to the speech synthesizer microprocessor 38 are programmed to cause a succession of sounds to be produced to form the desired words and phrases.

The microprocessor 22 may also send certain signals directly to sound circuitry 23. For example, the microprocessor may send signals signalling a bulls eye or a bust to the sound circuitry directly whereas announcements are provided by coupling data words to the speech synthesizer circuitry 37 for return to the sound circuitry 23 and the speaker 32. The microprocessor 22 also sends appropriate signals to the display circuitry such as the throw and remove dart indicator lamps 35 and control panel indicator lamps 31 which may also include the score indicators. Signals from the target head with switch matrix 25 are received by the target head interface circuitry 36 for conversion to a form which may readily be read and recognized by the target head input/output circuitry 34. The throw and remove darts indicator lamps 35 are driven by the target head input/output circuitry 34, which receives target head indicator lamp control signals from the microprocessor 22.

As will be appreciated by those skilled in this art, the microprocessor 22 must perform certain functions for housekeeping, initialization and the like, and such functions are not important to an understanding of the present invention. Reference is made to copending U.S. application Ser. No. 088,723, filed Aug. 24, 1987, in the names of Tillery and Beall for a description of such program functions. To the extent necessary for practice of the present invention, such disclosure is incorporated herein by reference.

Figure 5:
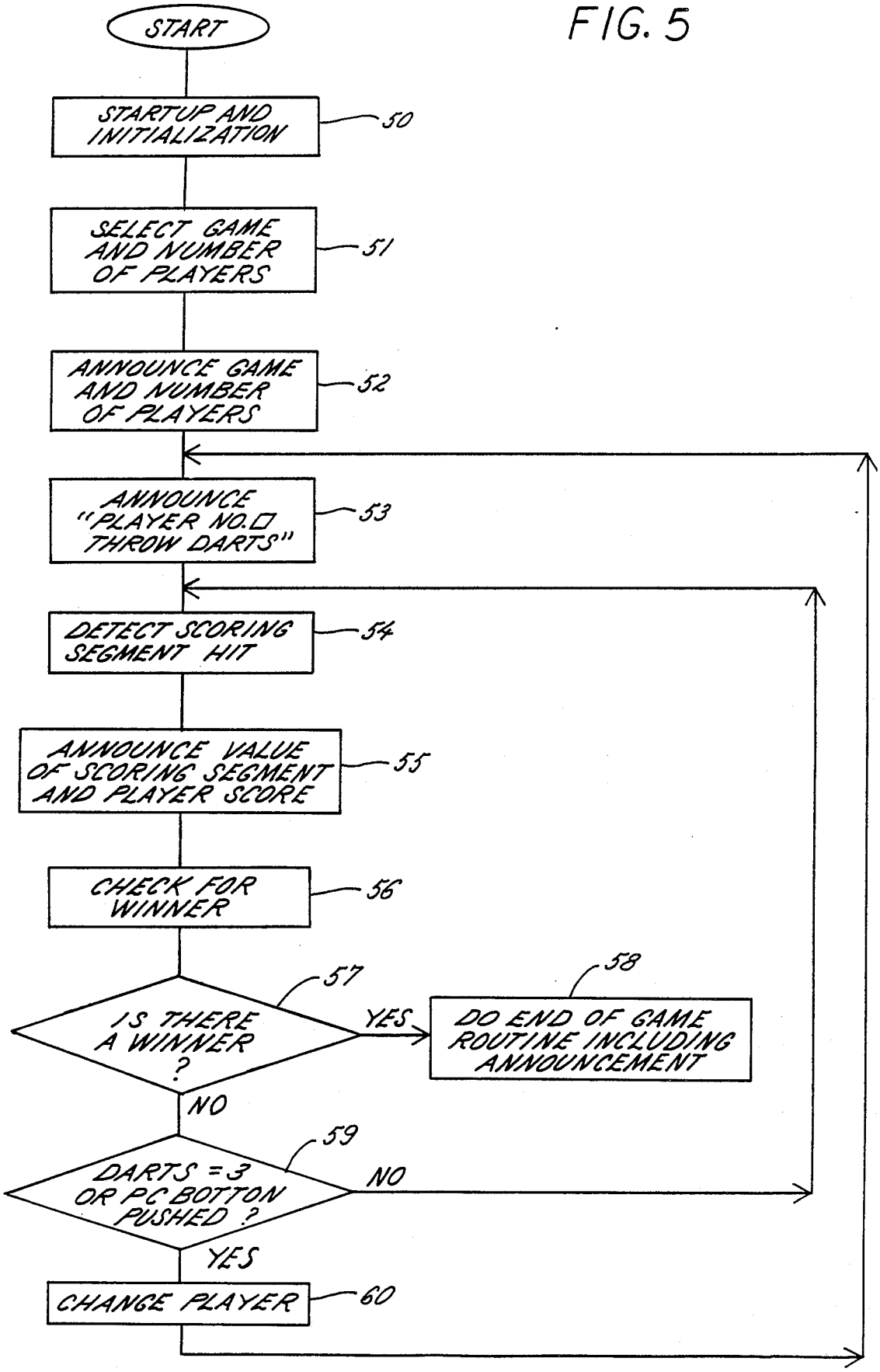
FIG. 5 is a flow chart illustrating the sequence of operations of the electronic dart game of FIG. 1 in audibly announcing sufficient information to direct and score the game without the need for viewing visible indicators.
Figure 6:
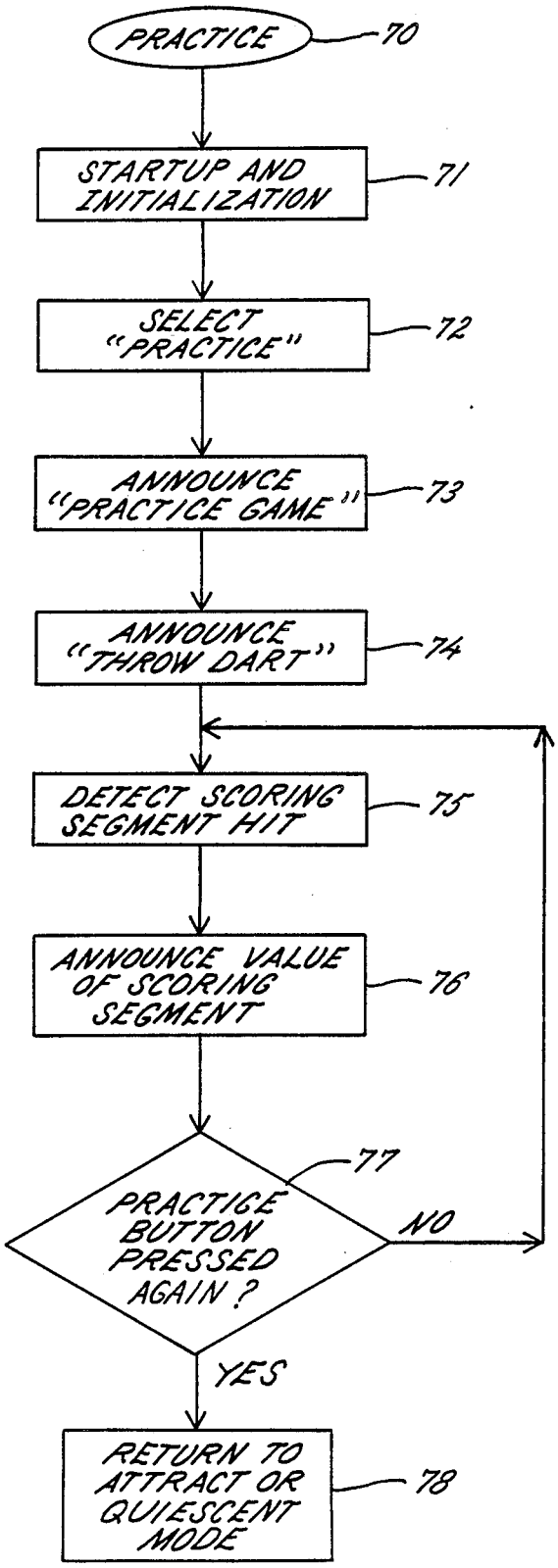
FIG. 6 is a flow chart illustrating the steps of a "Practice" game particularly, although not exclusively, suited for use by sight impaired persons.

Turning now to FIG. 5, there is shown a flow chart exemplifying the present invention in which announcing means are incorporated in an electronic automatically scoring dart game for providing sufficient audible information to guide a player through the advance of the game and also to score the game without the need for viewing of visible indicators.

As shown in FIG. 5, the basic program starts with a startup and initialization step 50 which is adequately described in the aforementioned Tillery and Beall application. After initialization, the game can enter the attract mode during which announcements such as "Let's Play English Mark Darts" are periodically made. When it is desired to play games, either by depositing of coins or by depressing of the pushbutton 18*a*, the program responds to such action by selecting the number of players, and in response to depression of one of game select switches 17 by selecting a particular game, all being summarized in the program step 51. After the game and number of players are selected, and in practicing the invention, a step 52 is performed to announce the name of the game and the number of players which are participating. A sequence of announcements for accomplishing the foregoing can be a first announcement which says "Two Players—Select Game" followed by an announcement responsive to depression of one of the game select switches such as "Count Up".

After a predetermined delay during which the player is getting in position on the rollout mat at the throwing line established by the integral member 44, the game announces "Player No._Throw Darts" in a step 53. The player, having positioned himself on the throwing line, and having heard the announcement, then throws a dart at the target head. When the dart hits the target head, a switch is closed in conventional fashion and the step 54 is performed by the microprocessor 22 to detect the fact that a scoring segment has been hit, and also to detect the value of the segment. The program then performs a step 55 to announce the value of the scoring segment which had been hit and the score of the player which was active in hitting the segment. For example, the game can announce "Triple 3", "Player No. 1 Your Score Is 150". A step 56 is then performed to determine if there is a winner. For example, in the game 301 if the player has reduced his score precisely to zero, the step 56 will determine that that player is a winner. A test is then performed at step 57 to determine if there is a winner. If there is, the program branches to a step 58 which performs an end-of-game routine including an announcement to indicate that one of the players has won and to identify the player who has won. For example, an announcement is made which says "Player No. 2 Wins", and a further announcement can be made which states "Game Over".

If in performing the test 57 if it is determined that there is no winner, the program continues to a further test 59 to determine if three darts have been thrown or the player change pushbutton depressed. If it is not, the program branches back to the step 54 to await the next dart thrown. The player having heard his score announced is appraised that he can throw the next dart, and the step 54 continues to scan the target head until a dart hit is detected. When it is, the program loop repeats as just described.

If the test 59 determines that three darts have been thrown or the player change pushbutton has been pressed, a change player step 60 is performed which increments the player number by one (or if the highest number player is shooting returns play to player No. 1). The program then returns to step 53 to announce the player number which is next active and instruct him to throw darts. The program continues to loop through the aforementioned steps until a winner is detected in step 57, and the winner is announced in the step 58.

It will now be apparent that after a sight-impaired person gains sufficient physical dexterity to reliably hit the target face 15 with the darts, and preferably sufficient physical dexterity to selectively throw at particular areas of the target face, the game including the announcing means will allow that player to play on his own without assistance from a player or spectator with sight.

Figure 3:
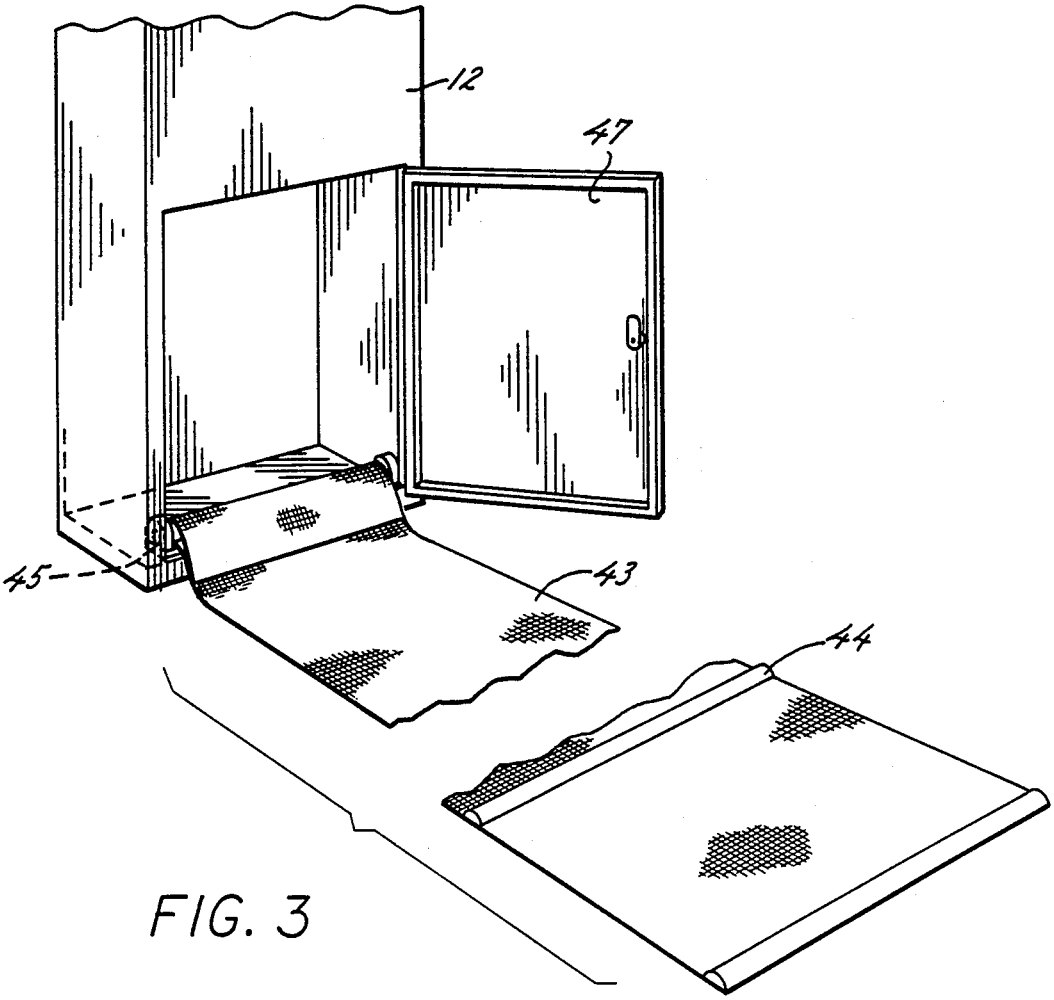

In further aid of gaining the necessary dexterity, a "Practice" game is provided, selectable by switch array 17 for allowing a player to achieve the necessary physical dexterity. In the practice game 70, a startup and initialization procedure 71 much as described in connection with FIG. 3 is provided. The player then depresses the appropriate switch within the cluster 17 to select the practice game, and a step 72 is performed to select "Practice". A step 73 is performed to confirm that the appropriate game has been selected and the enunciator means announces "Practice Game". Following the announcement, the game enunciator means further can state "Throw Darts" in a step 74. With the player in position on the rollout mat at the throwing line, and having heard the announcement "Throw Darts", he is in position to throw his first dart at the target head. The microprocessor 22 continues to scan the target head and in a step 75 detects a scoring segment being hit as well as a value of the scoring segment which had been hit. In a step 76, the announcing means is then driven by the microprocessor to announce the value of the scoring segment which has been hit such as "Single 17". The game is adapted to allow the continual throw of darts at the target face by a single player with the simple announcement of which target segment has been hit as an aid in allowing the player to hone his skills to target a particular value in the target head. A test 77 is provided which invariably tests negative to simply loop play back to the step 75 after announcing the value of a scoring segment to detect the next dart thrown and announce that value. In the event the test 77 tests positive, that is, the practice game is ended such as by a further depression of the practice button, the program branches to a step 78 which returns the game to the attract mode or other quiescent mode.

It will thus be appreciated that the practice game allows the player without becoming involved in the detailed rules of the game to simply throw darts at the target face and be advised of what target segment has been hit. Since the "environment" of all similar dart games will be the same by virtue of the integral rollout mat with fixed throwing line, the cabinet mounted dart head at a predetermined height, and the like, a player can go to a machine easily accessible to him for practice to hone his skills and later enter a tournament on a completely different machine but which feels exactly the same as the machine on which he practiced for competition.

It will now be appreciated that the invention provides the opportunity for sight-impaired persons to function in an environment typically associated with people of normal eyesight. Although a target game is involved, the practice mode in conjunction with the rollout mat with integral throwing line allows a person to achieve facility with hitting particular elements of the target without the opportunity for seeing them. That, coupled with the announcing means described in detail above which leads the player or players through the game while continually appraising them of their score provides the opportunity for sight-impaired persons to function independently in such an environment.

What is claimed is:

1. An electronic dart game capable of being played by one or more sight-impaired players throwing one or more safety tipped darts at a dart board to advance the game intermittently from throw to throw and player to player while keeping track of the score of each player, the electronic dart game comprising the combination of:

a dart board forming a target for the darts thrown by the players of the dart game, the dart board comprising a plurality of scoring segments, and a sensing means for detecting when one of the scoring segments is hit by a thrown dart, processor means responsive to the sensing means for determining which of the plurality of scoring segments has been hit and assigning a value to the hit scoring segment, the processor means, in response to determining the value of a hit segment, determining the advance of the game and the score for the player who had thrown the dart, and audible announcing means responsive to the processor means for audibly announcing, at least in part in words or phrases, sufficient information to score and direct a sight-impaired person through the game without the need for viewing of visible indicators, the audible announcement including an indication of the target segment hit by each thrown dart.

2. The electronic dart game of claim 1 in which the information to direct and score the game announced by the audible announcing means includes information with respect to all aspects of the entire game including at least (a) when the game is ready for the active player to throw a dart, (b) the identity of the active player, (c) the identity of the segment hit by each dart thrown by the active layer, and (d) the score of the active player.

3. An electronic dart game capable of being played by one or more sight-impaired players throwing one or more darts at a dart board to advance the game intermittently from throw to throw and player to player while keeping track of the score of each player, the electronic dart game comprising the combination of:

a dart board forming a target for the darts thrown by the players of the dart game, the dart board comprising a plurality of scoring segments, and a sensing means for detecting when one of the scoring segments is hit by a thrown dart, processor means responsive to the sensing means for determining which scoring segment of the plurality of segments has been hit and assigning a value to the hit scoring segment, the processor means, in response to determining the value of a hit segment, determining the advance of the game and the score for the player who had thrown the dart, and audible enunciator means responsive to the processor means for timely announcing, at least in part in words of phrases, audible information regarding the score and status of the game triggered by each hit of a scoring segment, the audible information being sufficient to direct a sight-impaired person through the game and including an announcement of the target segment hit by each thrown dart in a timely manner after the dart hits the target.

4. The electronic game of claim 3 in which the audible enunciator means announces sufficient information to direct all aspects of the entire game including at least (a) when the game is ready for the active player to throw a dart, (b) the identity of the active player, (c) the identity of the segment hit by each dart thrown by the active player dart, and (d) the score of the active player.

5. The electronic dart game of claim 4 in which the processor means includes means for operating in a practice mode in which the audible enunciator means announces the value of each hit segment, the practice mode employing the sensing means for triggering the audible announcing means to respond to each hit segment in a sequence of thrown darts to announce the value of the hit segment before the next dart in the sequence is thrown.

6. The electronic dart game of claim 4 wherein said dart game is in a floor standing cabinet and further comprising a rollout mat with integral elongate throwing line, space within the cabinet for storing the mat when rolled up, the rollout mat extending away from the front of the cabinet when rolled out, the integral throwing line extending above the surface of the mat when rolled out and parallel to the dart board to form a physically perceptible marker that provides a player via sense of touch with information regarding direction and distance to the dart board.

7. The electronic dart game of claim 3 further including a cabinet housing the game and supporting the target, an instruction panel on the cabinet, the instruction panel having a raised target and raised target values associated with the target for appraising a sight-impaired person of the nature of the target and the values of the segments.

8. The electronic dart game of claim 4 further including a cabinet housing the game and supporting the target, an instruction panel on the cabinet, the instruction panel having a raised target and raised target values associated with the target for appraising a sight-impaired person of the nature of the target and the values of the segments.

9. The electronic dart game of claim 3 in which the processor means includes means for operating in a practice mode in which the audible enunciator means announces the value of each hit segment, the practice mode employing the sensing means for triggering the audible announcing means to respond to each hit segment in a sequence of thrown darts to announce the value of the hit segment before the next dart in the sequence is thrown.

10. The electronic dart game of claim 3 wherein said dart game is in a floor standing cabinet and further comprising a rollout mat with integral elongate throwing line, space within the cabinet for storing the mat when rolled up, the rollout mat extending away from the front of the cabinet when rolled out, the integral throwing line extending above the surface of the mat when rolled out and parallel to the dart board to form a physically perceptible marker that provides a player via sense of touch with information regarding direction and distance to the dart board.

11. In a self contained, portable, electronic dart game structure having a target with scoring segments for safety tipped darts and adapted for rapid set up and play by one or more blind persons, the combination therewith comprising:

audible enunciator means for audibly announcing and directing at least in part by words or phrases all aspects of game startup and play, including (a) the identity of the active player, (b) when the game is ready for the active player to throw a dart, (c) the identity of the target segment hit by each dart thrown by the active player in a timely fashion after the thrown dart strikes the target, and (d) the score of the active player, and integral mat means for providing a player via sense of touch with information regarding direction and distance to a target of the dart game structure, the mat means being attached at one end to the dart game structure, being extendable from the dart game structure and including a raised throwing line, a spaced outer limit raised line, and a standing area between said raised lines, so that a player is positioned and directed to play the dart game by senses of touch and hearing only.

* * * * *